US011527232B2

(12) United States Patent
Dusan

(10) Patent No.: US 11,527,232 B2
(45) Date of Patent: Dec. 13, 2022

(54) APPLYING NOISE SUPPRESSION TO REMOTE AND LOCAL MICROPHONE SIGNALS

(71) Applicant: Apple Inc., Cupertino, CA (US)

(72) Inventor: Sorin Dusan, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/147,771

(22) Filed: Jan. 13, 2021

(65) Prior Publication Data

US 2022/0223135 A1 Jul. 14, 2022

(51) Int. Cl.
*G10K 11/178* (2006.01)
*H04R 29/00* (2006.01)
*H04R 3/00* (2006.01)

(52) U.S. Cl.
CPC ..... *G10K 11/17881* (2018.01); *H04R 3/005* (2013.01); *H04R 29/004* (2013.01); *H04R 2410/05* (2013.01)

(58) Field of Classification Search
CPC G10K 11/17881; H04R 3/005; H04R 29/004; H04R 2410/05
USPC ..... 381/71.1, 71.11, 71.12, 94.1
See application file for complete search history.

(56) References Cited

U.S. PATENT DOCUMENTS 7,464,029 B2 12/2008 Visser et al.
8,924,204 B2 12/2014 Chen et al.
9,100,756 B2 8/2015 Dusan et al.
9,418,675 B2 8/2016 Zhu et al.
9,966,067 B2 5/2018 Iyengar et al.
10,176,823 B2 1/2019 Dusan et al.
10,332,538 B1 6/2019 Dusan et al.
10,431,238 B1 10/2019 Biruski et al.
2007/0242839 A1* 10/2007 Kim ..... H04R 3/00 381/113
2013/0022214 A1* 1/2013 Dickins ..... G06F 3/04883 381/74
2014/0028649 A1 1/2014 Kim et al.
(Continued)

OTHER PUBLICATIONS

"Methods for Calculation of the Speech Intelligibility Index," American National Standard, Acoustical Society of America, ANSI S3.5-1997, Jun. 6, 1997, 28 pages.
(Continued)

*Primary Examiner* — William A Jerez Lora
(74) *Attorney, Agent, or Firm* — Womble Bond Dickinson (US) LLP

(57) ABSTRACT

A remote microphone signal is obtained from a remote device, and a local microphone signal from a local device. A difference between strength of the remote microphone signal and strength of the local microphone signal is determined. An output audio signal is produced to drive a speaker in the local device. If the difference is greater than a threshold, then the local and remote microphone signals are applied to two input channels, respectively, of a two channel noise suppressor which produces the output audio signal, but if the difference is less than the threshold after a certain delay since the difference was greater than the threshold, then only the remote microphone signal is applied to a single input of a single channel noise suppressor which produces the output audio signal. Other aspects are also described and claimed.

20 Claims, 5 Drawing Sheets

(56) References Cited

U.S. PATENT DOCUMENTS

2015/0325251 A1* 11/2015 Dusan ..... G10L 21/0208
704/226
2019/0074000 A1* 3/2019 Park ..... H04R 1/406

OTHER PUBLICATIONS

Huff, Chris, "How to EQ Speech for Maximum Intelligibility," Retrieved from the Internet <https://www.behindthemixer.com/how-eq-speech-maximum-intelligibility/>, 17 pages.
"Celementine Wear Wins the 2017 National Science Foundation's Hearables Challenge," Clementine Wear, Aug. 23, 2017, 4 pages.

* cited by examiner

APPLYING NOISE SUPPRESSION TO REMOTE AND LOCAL MICROPHONE SIGNALS

FIELD

The disclosure here generally relates to digital audio systems, including digital signal processing techniques for use in a remote listening system to improve intelligibility and suppress noise of a speech signal that contains ambient noise. Other aspects are also described

BACKGROUND

A remote listening system enables its user to more easily hear a person who is talking in a noisy acoustic environment. The system has a remote device such as the user's smartphone with a built-in microphone, that is placed close to the person who is talking. The user also has a local device such as a wireless headset that is being worn by the user and is in communication with the smartphone. The smartphone wirelessly transmits the remote microphone signal, which acoustically captures the speech of the person who is talking, to the headset. As a result the user is able to better hear the talker's speech despite the noisy ambient environment.

SUMMARY

In a remote listening system, a digital processor in a headset may align the sound that is captured in a remote microphone signal with the same sound as captured in a local microphone signal, in time, before presenting the two microphone signals to the two input channels, respectively, of a two channel noise suppressor. The noise suppressor processes the two microphone signals and then performs noise reduction upon the remote microphone signal which enhances the speech therein, and the latter is then converted to sound through a headset speaker.

Laboratory experimentation has revealed that using the two channel noise suppressor in a local device, to reduce ambient noise in a remote listening system, works well only when the distance d between the remote microphone and the sound source (e.g. a person talking) that the user is listening to is much smaller than the distance D between the sound source and the user who is wearing the local device. When d increases to for example one half of D, the two channel noise suppressor attenuates (undesirably) the sound coming from the desired sound source, instead of amplifying it.

In real usage scenarios, the desired condition of d being much smaller than D (d<<<D) is not always achieved or controllable by the user. In addition, users may not know or be aware that the two channel noise suppressor in such a remote listening system works better when the remote device is much closer to the sound source than to the local device.

Accordingly, one aspect of the disclosure here is an automatic method of changing a noise suppressor mode of operation in a remote listening system, from a two channel noise suppressor to a one channel suppressor, when d (the distance between the remote device and a desired sound source) becomes greater than a threshold. The threshold may be, for example, one half of D (the distance between the desired sound source and the local device.) The threshold represents the situation where the remote device is not placed sufficiently close to the talker or is too far away from the talker (e.g., because the talker moves away from the remote device, or someone has moved the remote device away from the talker.)

In one aspect, the method does not directly measure the distances d and D, but rather measures what may be equivalent, e.g., sound [pressure] levels in the remote microphone signal and in the local microphone signal, the powers of the two microphone signals, root mean square, RMS, values of the two microphone signals, all of which are encompassed here as the strengths of the two microphone signals. A difference between the strengths of the two microphone signals may be equivalent to the ratio between d and D. If the difference, remote microphone strength—local microphone strength, is less than a threshold then this suggests that the remote microphone at distance d is not close enough to the sound source, such that only the remote microphone signal is applied to a single channel input of a single channel noise suppressor. But if the difference is greater than the threshold then this suggests that the remote microphone at distance d is close enough to the sound source, and as such the local and remote microphone signals are applied simultaneously to the two input channels of two channel noise suppressor. In both cases, the noise suppressor produces an output audio signal that contains the desired sound from the sound source (e.g., speech of a talker) but with reduced ambient noise. The output audio signal is provided to drive a speaker in the local device, enabling the user to better hear the desired sound. Using such a method, the automatic change from the two channel noise suppressor to the single channel noise suppressor modes of operation advantageously prevents the system from attenuating the desired sound, when the source of the desired sound is not close enough to the remote microphone.

In another aspect, an intelligibility enhancer containing a spectral shaping filter and a power normalizer increases the speech intelligibility further without adding additional gain. The intelligibility enhancer may be derived from the speech intelligibility index (SII) models and has been shown to increase speech intelligibility without adding additional gain or strength to the remote microphone signal, in situations where the remote microphone signal may or may not be also processed by a noise suppressor.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
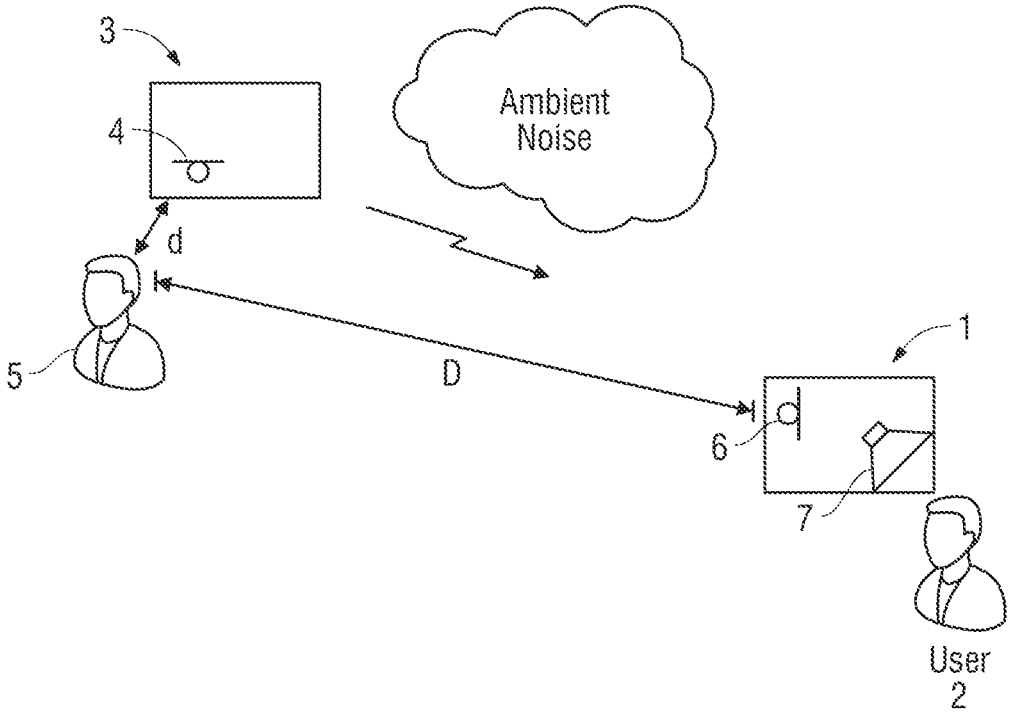
FIG. 1 shows a user and a remote listening system operating in a noisy ambient environment.

FIG. 1 is a schematic diagram of part of a remote listening system. The system has a local device 1 that may be a head worn device worn by a user 2, and a remote device 3 that is positioned close to a sound source 5 and is not worn by the user 2. In the example of FIG. 1 the sound source 5 is depicted as a person who is talking, but the system could also work with other sound sources, such as a television set or smart loudspeaker or other source of sound from which the noise suppressor can remove ambient noise before reproducing the sound to a user via a speaker 7. The sound source is said to be in the ambient sound environment of the user 2, such that when the ambient environment is quiet, the user 2 should be able to hear and understand the person who is talking (as the sound source 5.) But if the ambient environment is noisy, then the speech of the person who is talking may not be sufficiently intelligible to the user 2. The remote listening system helps the user 2 to better hear the sound source in a noisy ambient environment, by picking up the sound of the sound source 5 using a nearby, remote microphone 4 that is in the remote device 3, and sending the remote microphone signal to the local device 1 where it is actively reproduced through a speaker 7 (output sound transducer) of the local device 1. When the local device is a head worn device that is intended to be worn by the user 2, the speaker 7 may be positioned at an ear of the user 2. In one instance, the local device 1 as a head worn device may be a headset, or it may be a head mounted display device with built-in speakers. In contrast, the remote device 3 is not intended to be worn by the user and may be for example a smartphone or a tablet computer or other portable device that the user 2 can easily carry or have nearby.

Figure 2:
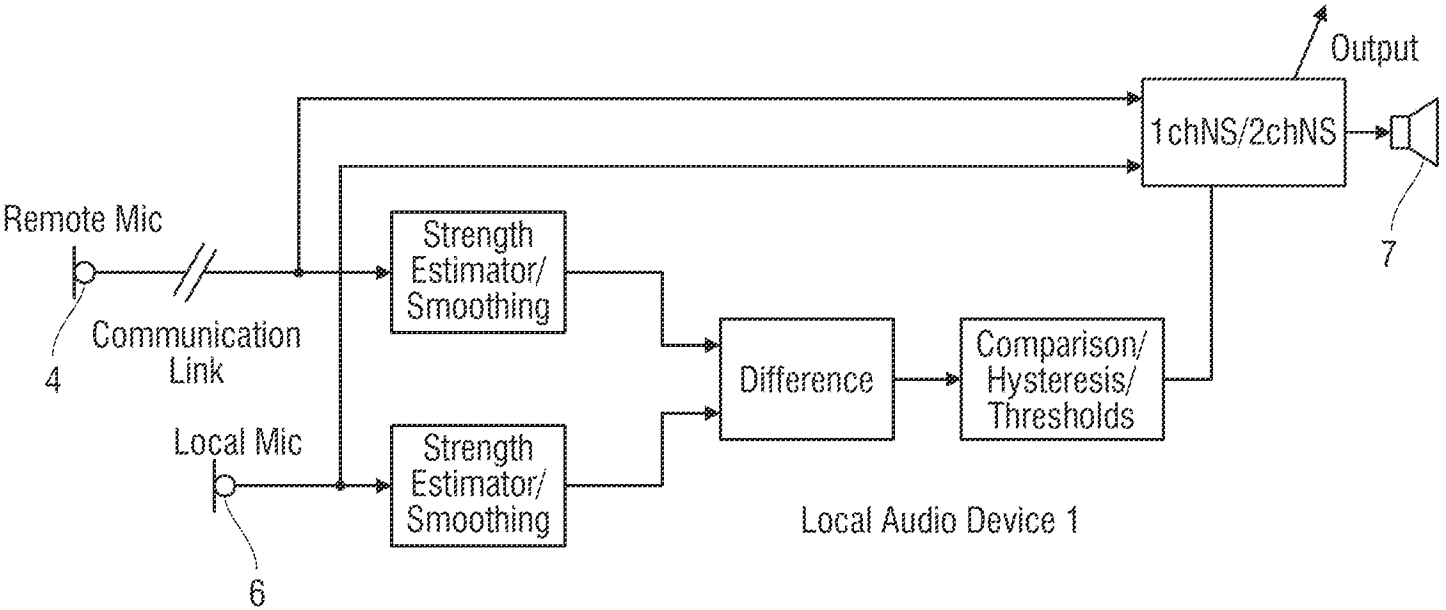
FIG. 2 is a block diagram of part of the remote listening system.

As seen in the block diagram of FIG. 2, the local device 1 has the speaker 7 (e.g., one or more headphone drivers), a local microphone 6 that produces a local microphone signal, and a communications interface (not shown) to receive the remote microphone signal produced by the remote microphone 4 and that was transmitted from the remote device 3. The communications interface may be wired (using a cable that carries the remote microphone signal from the remote device) or it may be wireless (receiving the remote microphone signal as an over the air transmission from the remote device.) The local device 1 also has a processor, and memory having stored therein instructions that configure the processor to apply a digital audio noise suppression method that uses the remote microphone signal and the local microphone signal to produce an output audio signal that drives the speaker 7. The acts performed by the processor are depicted by the following electronic hardware blocks: power estimator/smoothing, difference (ratio), comparison, and single channel and two channel noise suppressors, 1 chNS/2 chNs. Not shown are additional operations that may be performed by the processor to improve the accuracy or quality of the reproduced sound for the user 2, including aligning the sound that is captured in the remote microphone signal with the same sound as captured in the local microphone signal, in both time and strength, before presenting the two microphone signals to the noise suppression method. As explained in more detail below, the noise suppression method reproduces the sound of the sound source 5 (via the speaker 7) in such a way that enables the user 2 to for example more easily understand the speech of a person talking (when the sound source 5 is a person who is talking) despite a noisy ambient environment and both when the remote device 3 is and is not positioned close enough to the sound source 5.

As seen in FIG. 2, the local device 1 receives the remote microphone signal from the remote microphone 4, and the digital processor in the local device aligns a sound that is captured in the remote microphone, e.g., certain speech, with the sound as it has been captured in the local microphone signal, in both time and strength. The two, so-adjusted microphone signals are then passed to the input channels, respectively, of a two channel noise suppressor, 2 chNS. The two channel noise suppressor estimates noise based on its two input channels, in contrast to a single channel noise suppressor which estimates noise based on its single input channel and provides an enhanced (noise reduced) version of the audio signal in its single input channel. The two channel noise suppressor may adjust gain on one channel relative to the other, switch between channels, combine channels, subtract noise detected on one channel from the other channel and/or vice versa, reduce gain when no speech is detected, and/or perform other forms of noise suppression based on commonality or differences between the two channels, frequency domain analysis of signals, etc. in order to produce a single, noise reduced output audio signal. In both cases, the output audio signal of the noise suppressor is then converted to sound through the speaker 7, and as a result the user is able to better hear the talker's speech.

However, using the two channel noise suppressor in the local device to reduce ambient noise as described above works well only when the distance d between the remote microphone and the sound source 5 is much smaller than the distance D between the sound source 5 and the local microphone. Referring briefly back to FIG. 1, the two channel noise suppressor is effective only when d is much smaller than D, $d \ll D$. For example, if the threshold of the two channel noise suppressor to discriminate between signal and noise is set to 6 dB, when d increases to for example one half of D, the remote microphone 4 is no longer close enough to the sound source 5, resulting in the two channel noise suppressor to start attenuating (undesirably) the sound of the sound source 5 that has been picked up in the remote microphone signal (instead of letting it pass unattenuated, as desired.)

Moreover, in real usage scenarios of the remote listening system, the desired condition $d \lll D$ is not always achieved or controllable by the user 2. In addition, the user 2 may not know or be aware that the two channel noise suppressor works better when the remote device 3 is much closer to the sound source than to the user 2 and the local device 1.

Accordingly, one aspect of the disclosure here is an automatic method of changing a noise suppressor mode of operation in a remote listening system, from a two channel noise suppressor to a one channel suppressor, when d which is the distance between the remote microphone 4 and a desired sound source 5 becomes greater than a threshold. The threshold may be, for example, one half of D which is the distance between the desired sound source 5 and the local microphone 6. The threshold represents the situation where the remote device is not placed sufficiently close to the sound source 5, or is too far away from the sound source 5 (e.g., because the talker moves away from the remote device 3, or someone who is holding the remote device 3 moves away from the talker or places it too far away from the talker.)

As in the example with the two channel noise suppressor having the threshold of 6 dB, when d increases to about one half of D, the processor automatically signals a change in how the output audio signal is produced, from using the two channel noise suppressor to using the single channel noise suppressor.

Still referring to FIG. 2, the method begins with determining a difference between the strength of the remote microphone signal (obtained from the remote microphone 4) and the strength of the local microphone signal (obtained from the local microphone 6.) The strength of a digital audio signal may be estimated or computed by the processor as a power, for example on a frame by frame basis. The difference of the strengths in that case may be computed as a ratio of the power of the remote microphone signal to the power of the local microphone signal, within one or more audio frames (that may be overlapping in time.) Next, the comparison block determines whether or not the difference is greater than a threshold. If it is, then it provides a control signal to the 1 chNS/2 chNS block instructing the latter to apply the local and remote microphone signals to respective inputs of a two channel noise suppressor. The 1 chNS/2 chNS block at all times produces the (noise reduced) output audio signal that drives the speaker 7.

Returning to the comparison block, if the difference is less than the threshold then the comparison block provides a control signal to the 1 chNS/2 chNS block to apply the remote microphone signal only to a single input of a single channel noise suppressor (which produces the output audio signal that drives the speaker 7.) This changing between 1 chNS and 2 chNS modes of operation is illustrated using example remote and local microphone signals in FIG. 3. The strengths of the two microphone signals have been computed (in this example, as root mean square, RMS, values) and plotted in the graph of FIG. 3. When the difference, Diff, is above a threshold, the 2 chNS is selected, and when, after a certain waiting time, it is below the threshold the 1 chNS is selected (as depicted by the binary, 2 chNS zone control waveform.)

Figure 3:
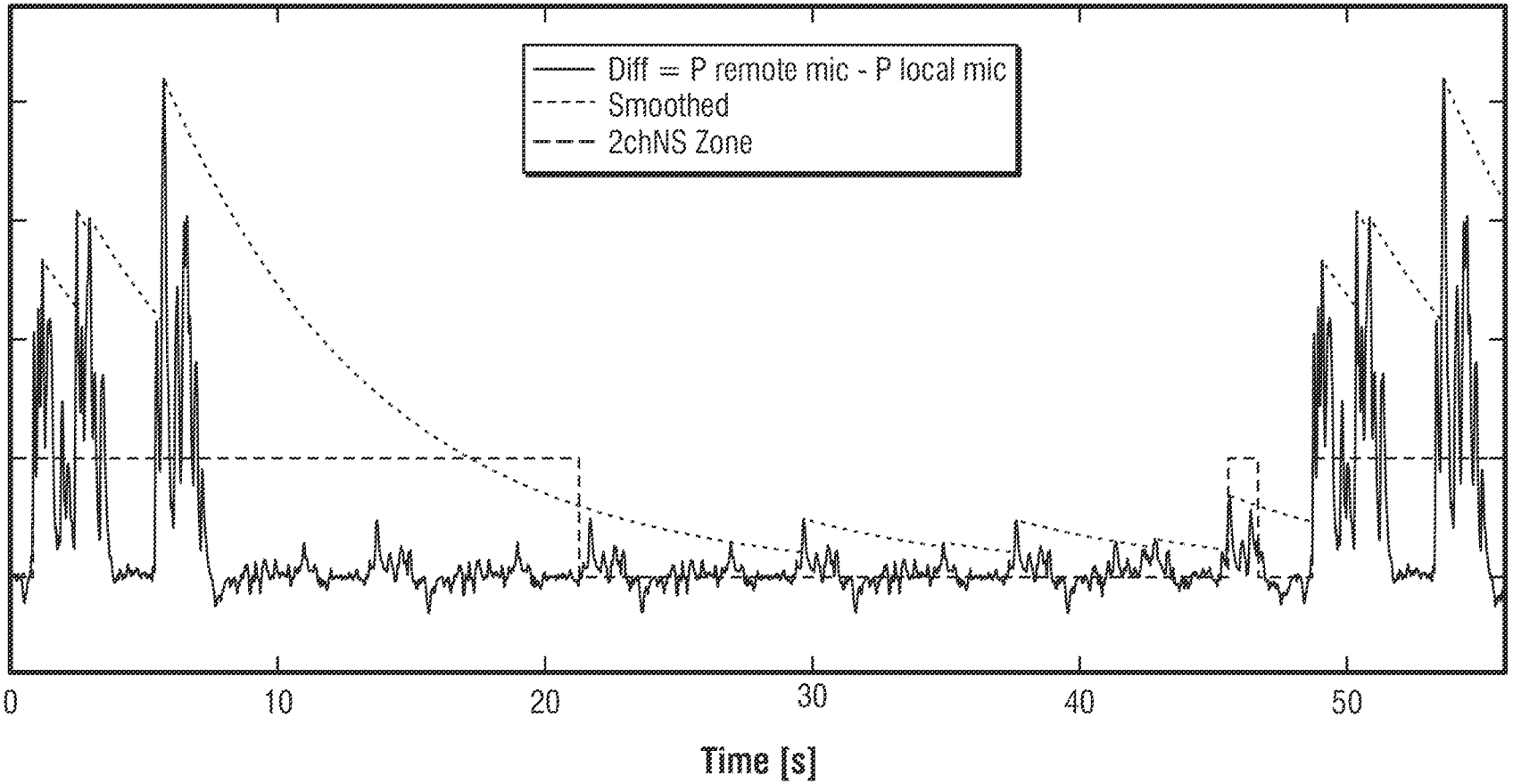
FIG. 3 illustrates an example of some relevant waveforms in the remote listening system.

FIG. 3 also illustrates several other aspects of the disclosure here. In one aspect, the processor is further configured to smooth the strength of the remote microphone signal, and smooth the strength of the local microphone signal, resulting in a smoothed difference curve, Diff, being computed, according to a smoothing parameter. The smoothing parameter may include an exponential decay parameter that controls how quickly the smoothed Diff curve decays from each peak. In another aspect, the threshold for determining when to stay in 2 chNS mode and when to change to 1 chNS mode comprises an upper value and a lower value (that is smaller than the upper value.) The upper value could be in a range of five to ten dB for example, while the lower value is in a range of zero to five dB for example. The two valued threshold supports hysteresis, in that Diff has to rise above the upper value in order to enter 2 chNS mode, and then Diff has to drop below the lower value in order to enter 1 chNS mode. By varying or adjusting the smoothing parameters and/or the two threshold values, the processor controls (varies) or sets the duration in which the system stays in 2 chNS mode after Diff has exceeded the upper value.

Figure 4:
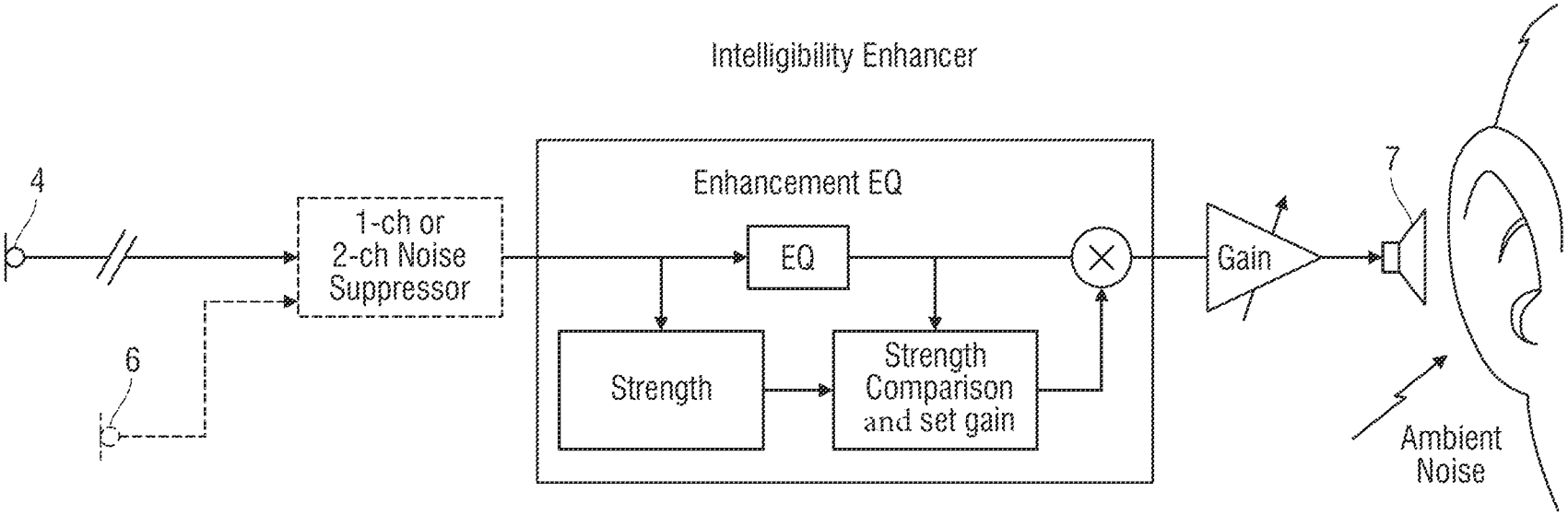
FIG. 4 is a block diagram of part of a remote listening system that has an intelligibility enhancer.

Improving Speech Intelligibility Through Spectral Shaping of the Remote Microphone Signal Referring now to FIG. 4, a remote listening system is depicted that has an intelligibility enhancer, in line with the remote microphone signal that is obtained from the remote microphone 4 (see also FIG. 1.) The intelligibility enhancer contains a wide band gain block that amplifies the remote microphone signal when driving the speaker 7 (in the local device 1), and before doing so may optionally pass the remote microphone signal through a single channel or a two channel noise suppressor. Note that the single channel noise suppressor may be implemented in the remote device 3 if desired. The enhancer also contains an enhancement equalization, EQ, block, which is a digital filter that imparts a specially designed spectral shaping or modification to the remote microphone signal. Note that the term "equalization" is used here merely to refer to spectral shaping, and does not mean that a result of applying the equalization process is a flat spectrum.

The elements of the intelligibility enhancer together serve to increase speech intelligibility by preserving the SNR in the ear canal of the user 2 to be the same as the SNR obtained with the un-enhanced remote microphone signal where leaking ambient noise (that leaks past the passive isolation provided by local device 1) is combined with the amplified and noise-reduced remote microphone signal. This intelligibility enhancement is obtained, on top of the enhancement that is due to the remote microphone 4 having a better SNR than the local microphone 6 because of the proximity to the sound source 5 (distance d being shorter than distance D, see FIG. 1.) The closer the remote microphone 4 is the source, the higher is the signal to noise ratio, SNR, in the remote microphone signal as compared to the SNR of the local microphone 6.

The enhancement EQ block has an EQ filter (a spectral shaping filter) that may be a fixed filter (not adaptive or dynamically varying over time) and may be described as follows. Studies by others have defined a speech intelligibility index, SII, that represents a measure of speech intelligibility which varies as a function of ambient noise level, distance from the source, speaking type, hearing loss and binaural or monaural hearing. The SII models were defined for four different speaking types, namely Normal, Raised, Loud, and Shout. The SII values or scores for the Raised, Loud, and Shout speech are in general progressively higher than those for the Normal speech in the same noise and hearing conditions. Since the SII models contain reference spectra for all these speaking types, it can be observed that the Raised, Loud, and Shout speech spectra are not only higher in level than the Normal speech spectra, but also with a frequency shift progressively towards higher frequencies, respectively. From these studies, the inventor of the present disclosure created three spectral shaping functions that describe the spectral differences between the speech spectra of Raised, Loud, and Shout speech, respectively, to the speech spectrum of Normal speech. Thus applying each of these spectral shaping functions to the Normal speech spectra one can generate the original speech spectra for Raised, Loud, and Shout speech. By subtracting from each of these three shaping functions the overall level difference between the Raised, Loud, and Shout speech spectra and of the Normal speech spectrum, respectively, three new shaping functions (final shaping functions) were obtained that have the same average level as that of the Normal speech spectrum but their speech energies are re-distributed, e.g., attenuated progressively at lower frequencies and boosted at higher frequencies. Laboratory experimentation showed that these new, spectrally shaped speech functions when applied to the original microphone speech spectra do in fact result in reduced word error rate, WER, or equivalently increased intelligibility, as compared to the remote microphone signal to which the spectrally shaped speech functions have not been applied.

Figure 5:
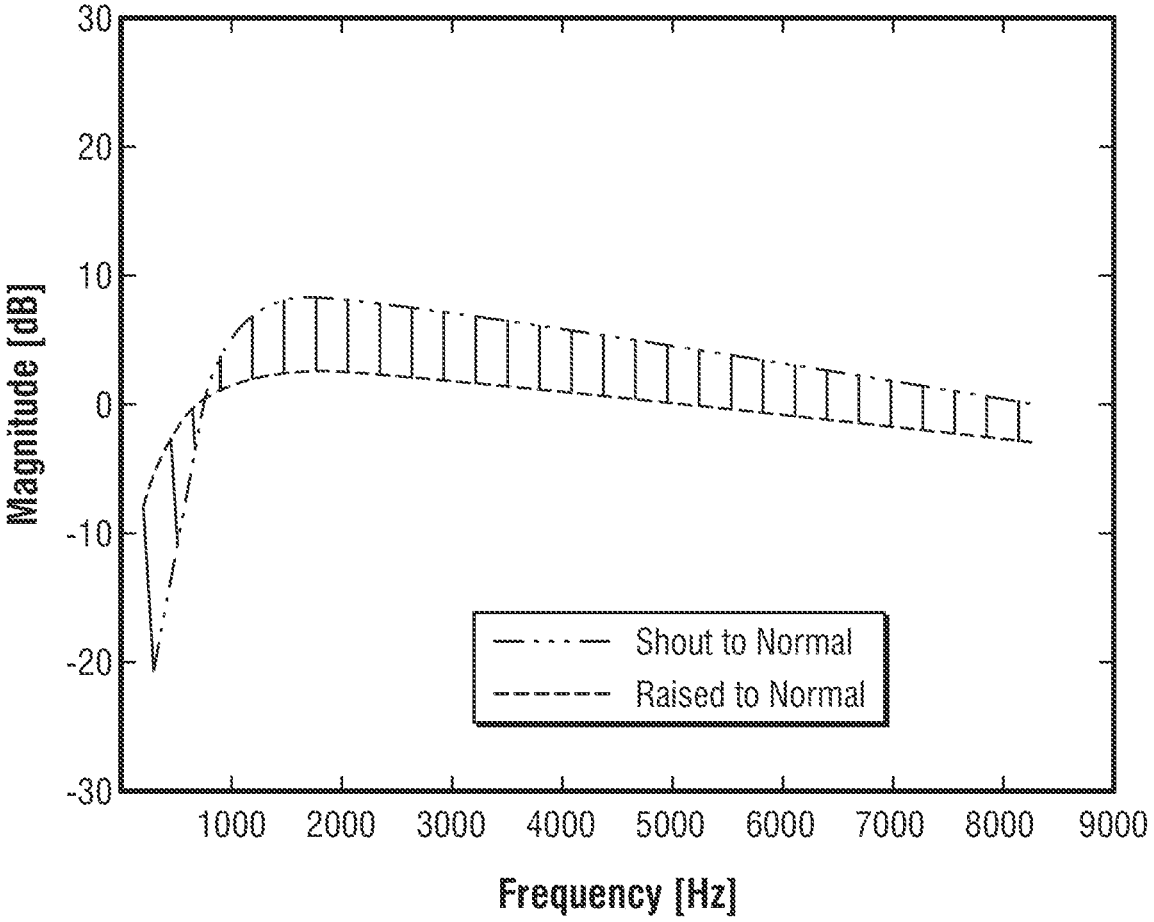
FIG. 5 shows a range of magnitude response of an equalization filter, used in the intelligibility enhancer, that covers a variety of speech types.

FIG. 5 illustrates the range of the magnitude response of these final shaping functions, e.g., the EQ filter, in the enhancement EQ block of FIG. 4. The boundaries of the range are i) a Shout to Normal magnitude shaping functions, and ii) a Raised to Normal magnitude shaping function, with the understanding that a Loud to Normal magnitude shaping function would fall in between those two. The range exhibits progressively increasing (progressively more) attenuation (in magnitude) below a cross-over frequency, progressively increasing boost (in magnitude) above the cross over frequency up to about 1000 Hz, progressively more boost in Shout to Normal shaping function than in Raised to Normal Shipping function, and monotonically decreasing magnitude from about 2500 Hz to 8 kHz. The cross-over frequency is between 500 Hz and 800 Hz. It is understood that by applying to the remote microphone signal the spectral shaping function for Shout to Normal a stronger increase in intelligibility would be obtained than by applying the Loud to Normal or Raised to Normal shaping functions.

Viewed another way, and as also seen in FIG. 5, the magnitude response of the EQ filter may have a first sub-range below the cross-over frequency in which there is attenuation between 1 dB to 20 dB, and a second sub-range above the cross-over frequency up to 3000 Hz in which there is boost between 1 to 9 dB.

FIG. 4 also shows a further aspect of the enhancement EQ block, as a side-chain process that sets a wide band gain as an additional adjustment to the remote microphone signal (additional to the filtering performed by the EQ filter.) This wide band relatively small gain (depicted as a circle with an X inside) may be attenuation or it may be boost, depending on the result of a strength comparison made between i) the strength of the remote microphone signal at the input to the EQ filter and ii) the strength of the remote microphone signal at the output of the EQ filter. Doing so ensures that the EQ filtered version of the remote microphone signal will have the same strength over several audio frames (e.g., root mean squared, power) as the unfiltered version of the remote microphone signal that is input to the EQ filter.

The following are examples of various aspects of the intelligibility enhancer. A method for enhancing speech intelligibility in a local device of a remote listening system, the method comprising: obtaining a remote microphone signal from a remote device; filtering the remote microphone signal using an equalization filter to produce a filtered remote microphone signal, wherein a magnitude response of the equalization filter exhibits progressively greater attenuation below a cross-over frequency and progressively greater boost above the cross-over frequency up to 1000 Hz, wherein the cross-over frequency is between 500 Hz and 800 Hz; and providing the filtered remote microphone signal to drive a speaker in the local device. In aspect of this method, the magnitude response of the equalization filter exhibits monotonically decreasing magnitude from 2500 Hz to 8 kHz. This method may further comprise: performing a comparison between strength of the remote microphone signal as input to the equalization filter and strength of the filtered remote microphone signal; and based on the comparison setting a gain that is applied to the filtered remote microphone signal in such a way that the power of the remote microphone signal is the same before the equalization filter and after the equalization filter.

In another example, a method for enhancing speech intelligibility in a local device, the method comprises: obtaining a remote microphone signal from a remote device; filtering the remote microphone signal using an equalization filter to produce a filtered remote microphone signal, wherein a magnitude response of the equalization filter has a first sub-range below a cross-over frequency in which there is attenuation between 1 dB to 20 dB, and a second sub-range above the cross-over frequency up to 3000 Hz in which there is boost between 1 to 9 dB, wherein the cross-over frequency is between 500 Hz and 800 Hz; and providing the filtered remote microphone signal to drive a speaker in the local device. In this method, the magnitude response of the equalization filter may exhibit monotonically decreasing magnitude from 2500 Hz to 8 kHz. Moreover, this method may further comprise equalizing strengths of the filtered remote microphone signal and the remote microphone signal as input to the equalization filter, by applying a gain to the filtered remote microphone signal.

While certain aspects have been described above and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, although FIG. 1 and FIG. 2 show a single microphone symbol as producing the remote microphone signal and the local microphone signal, respectively, it is understood that either or both of these microphone signals may be a beam formed signal that results from a beam forming process being applied to the multi-channel output of a microphone array. The description is thus to be regarded as illustrative instead of limiting.

What is claimed is:

1. A method for applying noise suppression in a local device using a remote microphone signal and a local microphone signal, the method comprising the following operations performed in a local device:

obtaining a remote microphone signal from a remote device, and a local microphone signal from the local device;

determining a difference between strength of the remote microphone signal and strength of the local microphone signal; and producing an output audio signal to drive a speaker in the local device, wherein the producing comprises i) if the difference is greater than a threshold, applying the local and remote microphone signals to two input channels, respectively, of a two channel noise suppressor that produces the output audio signal, and ii) if the difference is less than the threshold, applying only the remote microphone signal to a single input of a single channel noise suppressor which produces the output audio signal.

2. The method of claim 1 wherein if the difference is less than the threshold and an amount of time that has passed since the difference was above the threshold is within a certain delay, then the local and remote microphone signals are applied to the two input channels, respectively, of the two channel noise suppressor which produces the output audio signal.

3. The method of claim 2 wherein if the difference is less than the threshold and the amount of time that has passed since the difference was above the threshold is greater than the certain delay, then only the remote microphone signal is applied to the single input of the single channel noise suppressor.

4. The method of claim 1 wherein the local device is a head worn device worn by a user, and the remote device is not worn by the user.

5. The method of claim 4 wherein the local device is a headset, and the remote device is a smartphone or a tablet computer.

6. The method of claim 4 wherein obtaining the remote microphone signal comprises receiving the remote microphone signal from the remote device via a wireless communication link.

7. The method of claim 4 wherein at least one of the remote microphone signal and the local microphone is a beam formed signal.

8. The method of claim 4 wherein determining a difference between strength of the remote microphone signal and strength of the local microphone signal comprises computing a ratio of power of the remote microphone signal to power of the local microphone signal.

9. The method of claim 4 wherein the single channel noise suppressor estimates noise based on the single input channel, and the two channel noise suppressor estimates noise based on the two input channels.

10. The method of claim 4 wherein the threshold comprises an upper value and a lower value that is smaller than the upper value, the upper value being in a range of five to ten dB, and the lower value being in a range of zero to five dB.

11. A local device comprising a headset housing having therein:

a speaker;

a microphone to produce a local microphone signal;

a wireless communications interface to receive a remote microphone signal transmitted wirelessly from a remote device;

a processor; and memory having stored therein instructions that configure the processor to apply noise suppression using the remote microphone signal and the local microphone signal to produce an output audio signal that drives the speaker, by determining a difference between strength of the remote microphone signal and strength of the local microphone signal, and if the difference is greater than a threshold, then applying the local and remote microphone signals to respective inputs of a two channel noise suppressor which produces the output audio signal, and if the difference is less than the threshold then applying one, not both, of the local and remote microphone signals to an input of a single channel noise suppressor which produces the output audio signal.

12. The local device of claim 11 wherein at least one of the remote microphone signal and the local microphone signal is a beam formed signal.

13. The local device of claim 11 wherein determining the difference comprises computing a ratio of power of the remote microphone signal to power of the local microphone signal.

14. The local device of claim 11 wherein the processor is further configured to smooth the strength of the remote microphone signal and smooth the strength of the local microphone signal when determining the difference, according to a smoothing parameter, and the threshold comprises an upper value and a lower value.

15. The local device of claim 14 wherein the processor is configured to control a duration in which the two channel noise suppressor is producing the output audio signal after the difference has exceeded the upper value of the threshold, based on the smoothing parameter and based on the lower value of the threshold.

16. The local device of claim 11 wherein if the difference is less than the threshold and an amount of time that has passed since the difference was above the threshold is within a certain delay, then the local and remote microphone signals are applied to the inputs, respectively, of the two channel noise suppressor which produces the output audio signal.

17. The local device of claim 16 wherein if the difference is less than the threshold and the amount of time that has passed since the difference was above the threshold is greater than the certain delay, then only the remote microphone signal is applied to the input of the single channel noise suppressor.

18. The local device of claim 11 wherein the local device is a head worn device worn by a user and the remote device is not worn by the user.

19. The local device of claim 18 wherein the local device is a headset, and the remote device is a smartphone or a tablet computer.

20. The local device of claim 18 wherein the single channel noise suppressor estimates noise based on a single input channel, and the two channel noise suppressor estimates noise based on two input channels.

* * * * *